US010455879B2

(12) United States Patent
Guice

(10) Patent No.: US 10,455,879 B2
(45) Date of Patent: Oct. 29, 2019

(54) SHOWER CAP WITH WIDE BAND

(71) Applicant: Gayla Marie Guice, Ocean Springs, MS (US)

(72) Inventor: Gayla Marie Guice, Ocean Springs, MS (US)

( * ) Notice: Subject to any disclaimer, the term of this patent is extended or adjusted under 35 U.S.C. 154(b) by 255 days.

(21) Appl. No.: 15/602,553

(22) Filed: May 23, 2017

(65) Prior Publication Data

US 2017/0360138 A1 Dec. 21, 2017

Related U.S. Application Data

(60) Provisional application No. 62/351,029, filed on Jun. 16, 2016.

(51) Int. Cl.

| | |
|---|---|
| ***A42B 1/12*** | (2006.01) |
| ***A42B 1/22*** | (2006.01) |
| ***A42B 1/20*** | (2006.01) |
| *A42B 1/00* | (2006.01) |
| *A42B 1/04* | (2006.01) |
| *A45D 8/40* | (2006.01) |

(52) U.S. Cl.

CPC ..... *A42B 1/12* (2013.01); *A42B 1/206* (2013.01); *A42B 1/225* (2013.01); *A42B 1/006* (2013.01); *A42B 1/041* (2013.01); *A45D 8/40* (2013.01)

(58) Field of Classification Search

CPC ..... A42B 1/12; A42B 1/043; A42B 1/201; A42B 1/206; A42B 1/225; A42B 1/006; A42B 1/041; A42B 1/22; A45D 8/40; A45B 8/00; A45B 8/14

USPC ..... 2/68, 275

See application file for complete search history.

(56) References Cited

U.S. PATENT DOCUMENTS

| | | | | | |
|---|---|---|---|---|---|
| 1,144,121 | A | * | 6/1915 | Guinzburg | A42B 1/12 2/68 |
| 1,172,927 | A | * | 2/1916 | Bloch | A42B 1/12 2/209.12 |
| 1,598,379 | A | | 8/1926 | Kerr | |
| 1,948,556 | A | * | 2/1934 | Armsby | A45D 8/40 2/174 |
| 2,211,184 | A | * | 8/1940 | Varell | A42B 1/041 2/174 |
| 2,468,937 | A | * | 5/1949 | McCaffrey | A42B 1/041 2/174 |
| 2,775,973 | A | | 1/1957 | McDonough | |
| 3,131,401 | A | | 5/1964 | Brown | |
| 3,234,563 | A | | 2/1966 | Tabbat | |
| 3,268,913 | A | * | 8/1966 | Gettinger | A42B 1/041 2/171 |
| 3,357,027 | A | * | 12/1967 | Feil | A42B 1/041 2/204 |
| 3,392,737 | A | | 7/1968 | Fefferman | |
| 3,561,455 | A | | 2/1971 | Gregg | |
| 3,714,670 | A | * | 2/1973 | Pollack | A42B 1/12 2/183 |

(Continued)

*Primary Examiner* — Katharine Gracz

(74) *Attorney, Agent, or Firm* — Carter, DeLuca & Farrell LLP

(57) ABSTRACT

A bathing cap/shower cap with a wide band that helps prevent shift and elastic creases in the forehead, and that, without tucking, lifts the hair up and above the hairline and completely off of the face and neck and toward the top of the head where it is protected by a sturdy waterproof material sealed with a "snap, cuff, and fasten" system that includes magnetic snaps and hook and loop fastening tape.

19 Claims, 8 Drawing Sheets

(56) References Cited

U.S. PATENT DOCUMENTS 3,750,681 A 8/1973 Claunch
4,165,542 A 8/1979 McLaughlin
4,400,830 A * 8/1983 Gaitan ..... A42B 1/12 2/68
4,457,027 A * 7/1984 Gladstone ..... A42B 1/046 2/174
4,698,853 A 10/1987 Walton
4,937,885 A * 7/1990 Gregg ..... A42B 1/006 2/171
5,218,723 A * 6/1993 McLaughlin ..... A42B 1/043 2/125
5,490,528 A * 2/1996 Day ..... A42B 1/04 132/200
5,579,540 A 12/1996 Walker
5,708,982 A * 1/1998 Armani ..... A45D 8/40 2/171
5,920,909 A * 7/1999 Ellsworth ..... A41D 23/00 132/273
5,950,636 A * 9/1999 Hickey ..... A45D 2/46 132/200
5,978,967 A 11/1999 Williams
6,185,749 B1 2/2001 Williams
6,351,852 B1 3/2002 Propp
6,560,784 B2 5/2003 Hill
8,316,466 B2 * 11/2012 Saito ..... A42B 1/041 2/202
8,621,668 B1 * 1/2014 Nolz ..... A42B 5/00 2/171.4
9,138,025 B1 * 9/2015 Lunsford ..... A42B 1/041
9,398,780 B1 * 7/2016 Matallana ..... A42B 1/12
2003/0183629 A1 * 10/2003 Wang ..... A42B 1/006 220/9.2
2004/0094179 A1 * 5/2004 Baldwin ..... A45D 8/40 132/274
2006/0168709 A1 * 8/2006 Rattay ..... A42B 1/201 2/183
2006/0179544 A1 * 8/2006 Knievel ..... A42B 1/041 2/181
2009/0070920 A1 * 3/2009 Holloway ..... A42B 3/003 2/422
2009/0151048 A1 * 6/2009 Laury ..... A42B 1/043 2/202
2009/0293177 A1 * 12/2009 Adkins ..... A42B 1/041 2/171
2010/0275946 A1 * 11/2010 Ruschell ..... A41D 20/00 132/210
2013/0174321 A1 7/2013 Bundy et al.
2013/0298929 A1 * 11/2013 Cole ..... A42B 1/12 132/200
2013/0326795 A1 * 12/2013 Ortiz ..... A41D 15/00 2/243.1
2014/0101821 A1 * 4/2014 Dammann ..... A42B 1/22 2/171.4
2015/0000002 A1 * 1/2015 Brown ..... A42B 1/12 2/68
2015/0282585 A1 * 10/2015 McFarlane ..... A45D 8/40 132/273
2015/0320180 A1 * 11/2015 McGuire ..... A45D 44/08 2/50
2015/0359284 A1 * 12/2015 Watson ..... A42B 1/12 2/174
2015/0366329 A1 * 12/2015 Manning ..... A45D 44/08 2/50
2016/0135532 A1 * 5/2016 Wilson ..... A42B 1/006 2/158
2016/0360816 A1 12/2016 Bundy et al.
2017/0027262 A1 * 2/2017 Palmer ..... A42B 1/12
2017/0042267 A1 2/2017 Guice
2017/0042268 A1 * 2/2017 Lessard ..... A42B 1/041
2018/0249804 A1 * 9/2018 Walker ..... A45D 20/18

* cited by examiner

SHOWER CAP WITH WIDE BAND

CROSS-REFERENCE TO RELATED APPLICATIONS

This application claims the benefit of an earlier filed provisional application, U.S. Pat. Application No. 62/351,029, filed Jun. 16, 2016, the contents of which are incorporated herein by reference.

TECHNICAL FIELD

The present invention relates to bathing caps and/or shower caps.

BACKGROUND ART

The main function of conventional shower caps/bathing caps is to keep the wearer's hair dry while the wearer engages activities wherein the hair may become wet, like showering, or bathing. Another function that the shower cap serves is keeping the hair lifted and out of the user's way, so that the user may freely wash the face and neck. It is known that the common shower cap is basically comprised of a plastic or vinyl material cut into a circular shape, the circumference of which is gathered by elastic. This design suffers many shortcomings.

Using a shower cap proves time consuming and frustrating for many women because it is necessary to tuck the hair into the one opening of the shower cap. Because in some cases it is impossible to tuck all of the hair, the shower cap does not offer protection against moisture at the hairline. Conventional shower caps also offer little stability and often shift with the weight of the hair, causing the confined hair to fall into the way—around the face and/or neck of the wearer—rendering the cap ineffective, annoying and uncomfortable. Women also complain about creases in the forehead made by the elastic which is sometimes encased (in a channel) or not encased (exposed). Also, women have expressed concern with the lack of breathability offered by the plastic typically used for shower caps.

In order to gain the benefit of confining the hair without tucking, some women began using the Tassi hair wrap, a product which is protected by U.S. Pat. No. 5,920,909. The Tassi can be applied to the head by inserting the head through two openings, obviating the need to tuck the hair. It also allows the hair to breathe. However, it provides no waterproof component. It also features a pocket at the rear that hangs below the hairline, onto the nape of the neck, which does not work well for bathing and therapeutic soaking because the neck cannot be fully submerged into the water without the pocket of hair dipping into the bathwater and becoming wet.

U.S. patent application Ser. No. 14/756,154 proposes the benefit of two openings in a bathing cap, possessing a waterproof layer and hair confining layer, in order to obviate the need to tuck the hair into a shower cap. The wearer gains the benefit of ease of application because of the two openings, and derives the benefit of protection from splashing water because of the waterproof layer, and still, the wearer's hair is allowed to breathe because the second opening remains open. Additionally, because the bathing cap lifts the hair completely off of the nape of the neck, the user can submerge her neck completely into a bath of water. U.S. patent application Ser. No. 15/222,401 later proposed a waterproof head covering with the benefit of two openings, the second of which can be closed with a draw-cord system.

The design, however, fails to lift the hair above the hairline and more importantly, completely off of the neck, thereby preventing a wearer from allowing water to come into direct contact with her neck, without the confined hair being in the way. It also suffers the shortcoming of using elastic in the opening that fits around the forehead.

There is a need for a shower cap/bathing cap that lifts the hair up above the hairline and completely off of the face and neck, while providing additional protection at the crown of the head, and that offers more stability to the lifted and confined hair, while not creating elastic creases in the forehead.

SUMMARY OF INVENTION

The object of the present invention is to provide a shower cap that, without tucking, lifts the hair up above the hairline and away from both the face and nape of the neck and toward the top of the head where it is completely confined by a waterproof material which is, during application, sealed at the crown of the head, by a system of magnetic snaps, a cuff, and two strips of hook and loop fastening tape, and that fits, with a wide band, securely and without shifting or leaving creases in the forehead.

In a first aspect, the present invention solves the problem of confined hair falling below the hairline by providing a shower cap that lifts the hair up above the hairline and off of the nape of the neck, toward the top of the head, by using a waterproof material that possesses a relatively stiff hand or "body," and a "snap, cuff, and fasten" system to seal the cap at the crown of the head.

In a second aspect, the present invention solves the problem of shifting caps by providing a shower cap that is made with an extra wide band constructed to provide stability, as well as assisting in lifting the hair above the hairline.

In a third aspect, the present invention solves the problem of marks and/or creases made in the forehead by the elastic in shower caps, by providing a shower cap that is made without elastic.

BRIEF DESCRIPTION OF DRAWINGS

FIG. 3A shows the wearer engaging the magnetic snaps by pulling outwardly on each side of the cap. FIG. 3B shows the wearer creating a cuff by rolling the magnetically snapped opening forward toward her face. The wearer then completes the seal at the crown, as shown in FIG. 3C, by bringing the two strips of hook and loop fastening tape toward the back of her head and pressing them together.

DESCRIPTION OF EMBODIMENTS

Figure 1:
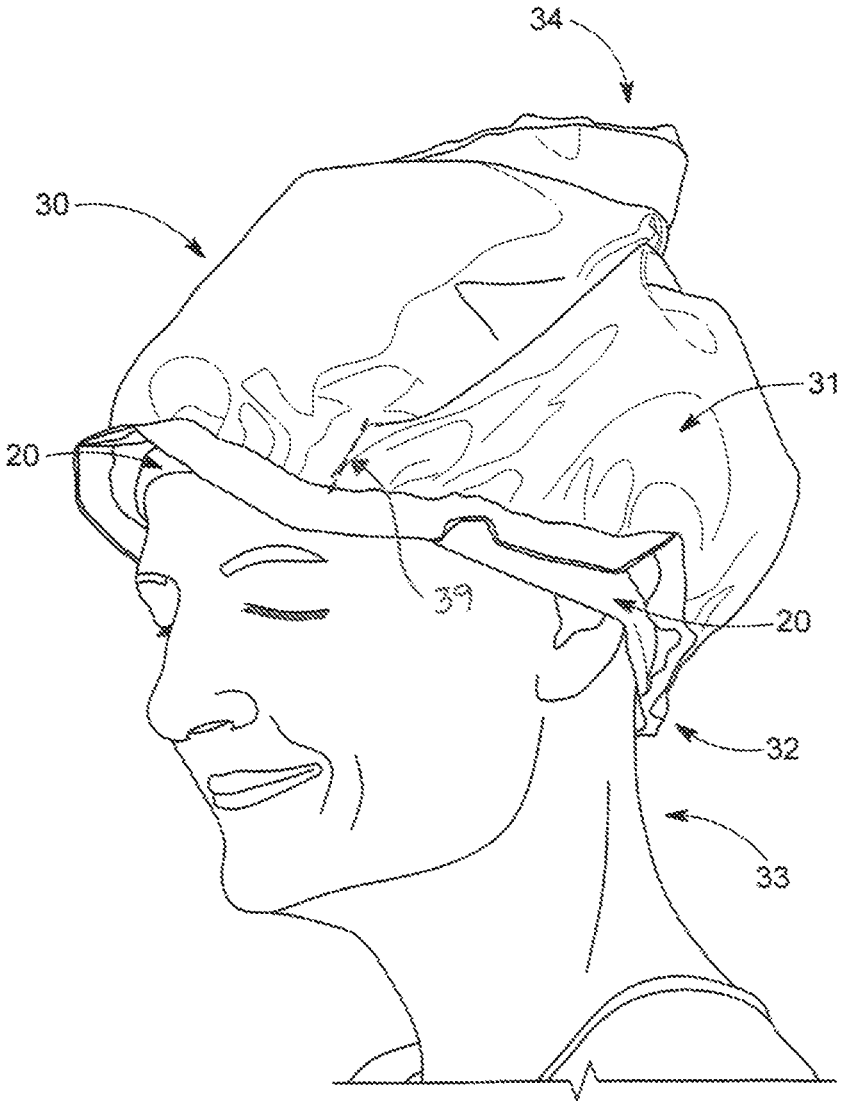
FIG. 1 shows a perspective side view of a preferred embodiment of the shower cap of the present invention completely applied onto the head of a wearer.

Referring now, in more detail, to the drawings, in which like numerals represent like parts throughout the several views, FIG. 1 shows a preferred embodiment of the shower cap 30 of the present invention on the head of a wearer. When completely applied, the wearer's hair, which has been confined inside the shower cap, sits predominantly toward the top of the wearer's head where it is steadfastly held in place by an attached wide band 20 reinforced in more than one location by a tack stitch, 39 a waterproof material 31 with a stiff hand, and a "snap, cuff, and fasten" system 34 that seals the upper opening of the shower cap at the crown of the wearer's head. The wearer's confined hair is kept significantly above the hairline 32 and does not fall onto the nape of the neck 33.

Figure 2:
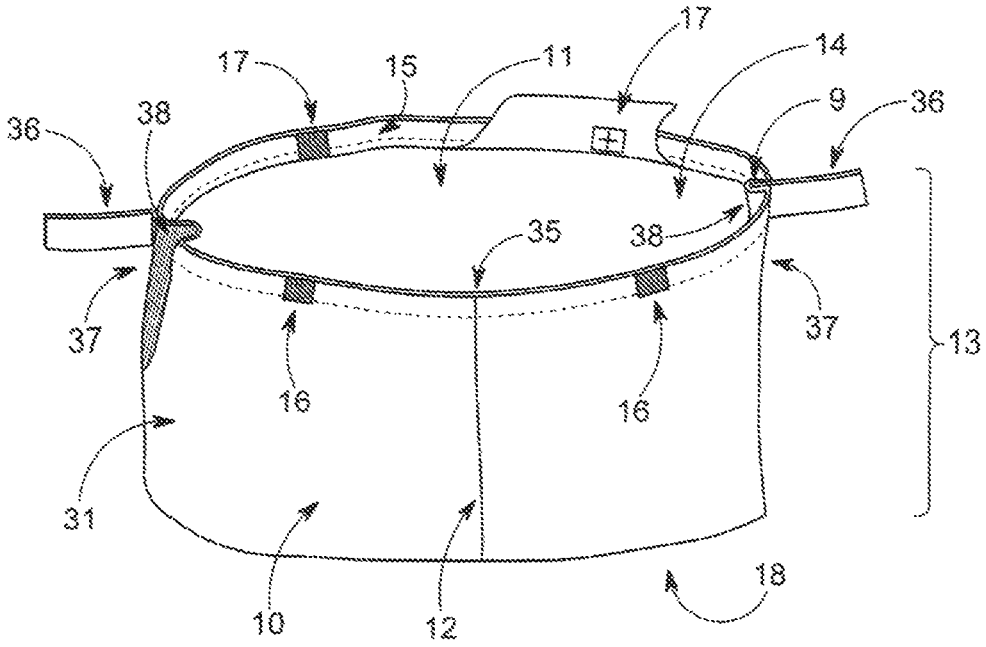
FIG. 2 shows a section of material, which is joined to be uniformly column-shaped, possessing an upper opening of a preferred embodiment of the shower cap of the present invention comprising magnetic snaps installed within a hem and strips of hook and loop fastening tape installed within darts. For ease of understanding, the magnetic snaps are shown even though they would not be visible in the finished hem of the shower cap.

FIG. 2 shows a section of material, preferably laminated cotton, being waterproof on one side 10 and non-waterproof on the other side 11 which is, preferably by sewing, joined 12 to be uniformly column-shaped to a dimension measuring 28.5-29 inches in circumference and 13 inches in height 13 and possessing a center back 35 established by the connecting seam 12. Once thusly joined, the section of waterproof material 31 possesses an upper opening 14 at which location is sewn a 1-inch hem 15, into which two male magnetic snaps 16 is sewn at a location approximately 2.5 inches away from the center back 35 and on each side of the center back 36, and the same hem into which is sewn, two female magneto snaps 17, at a location in the hem opposite the male magnetic snaps 16, so as to attract and effectively close the upper opening—this closing being the first of three steps in the "snap, cuff, and fasten" system used to substantially seal the upper opening 14.

The third of three steps used in sealing the upper opening 14 of a preferred embodiment of the shower cap of the present invention utilizes fasteners, for example, strips of hook and loop fastening tape 36, such as Velcro® ONE-WRAP®. As shown in FIG. 2, the strips of hook and loop fastening tape 36 are installed at a location approximately 6.75 inches from the center back 35 and on both sides of the center back 35, these two locations being here established as the sides 37. On each side 37 of the upper opening 14, e.g., at diametrically-opposed positions, an inwardly facing dart 38 measuring approximately 0.25 inches is formed, beginning at the edge of the finished opening and ending at a location below the hem seam that is more than two inches and less than 6 inches. Strips of preferably 0.75-inch-wide hook and loop fastening tape 36, cut to a length of preferably 2.25 inches long, are then inserted into each dart 38 and then stitched 9 on the non-waterproof side 11 of the material. Alternatively, the fasteners may include straps attached to parachute clips or tie-able strips of waterproof material inserted into the darts 38 instead of strips of hook and loop fastening tape 36. In embodiments, the fasteners may include one or more tin ties to be threaded through the hem and protruding therefrom.

Figure 3A:
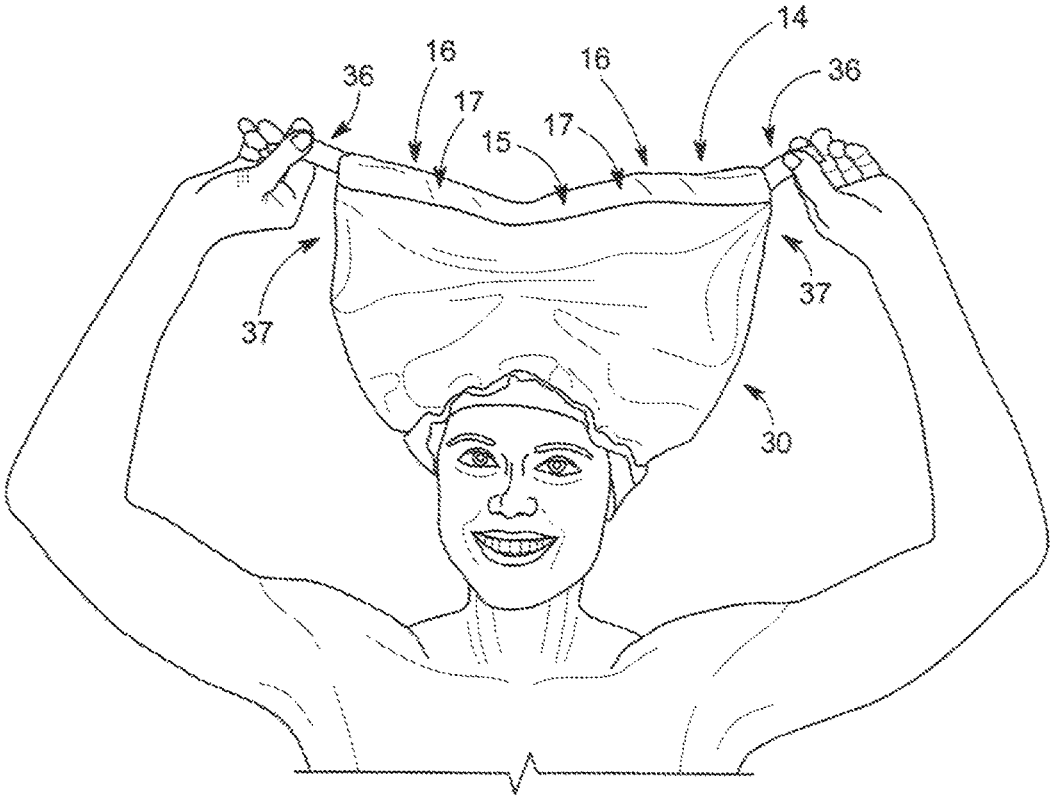
FIGS. 3A-3C show perspective front views of a preferred process used to seal the upper opening of a preferred embodiment of the shower cap of the present invention.
Figure 3B:
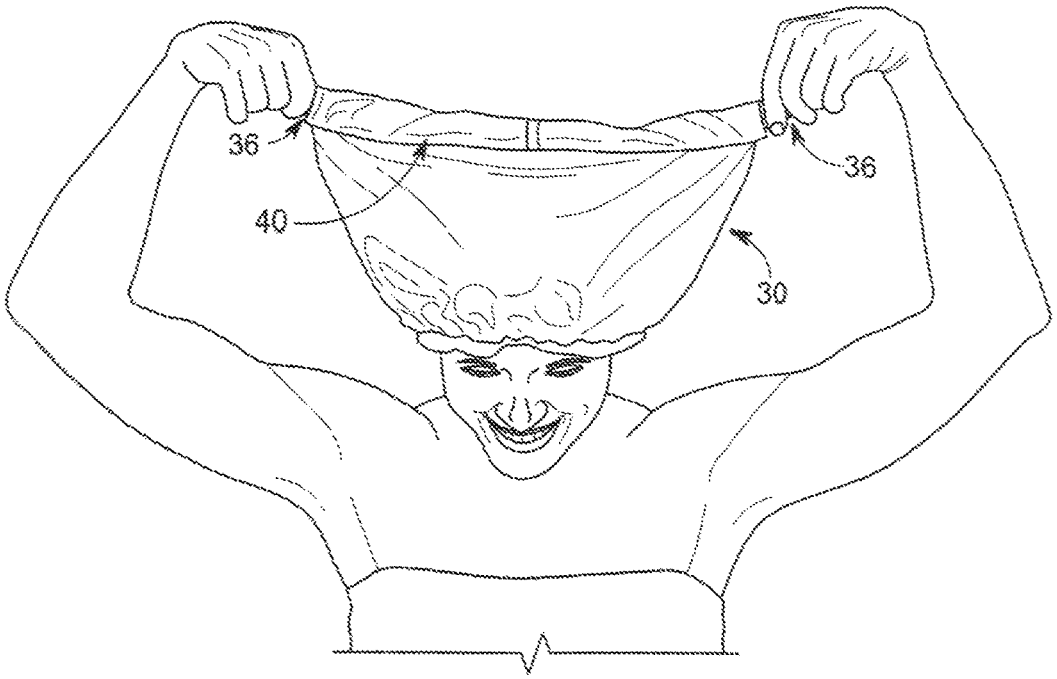
Figure 3C:
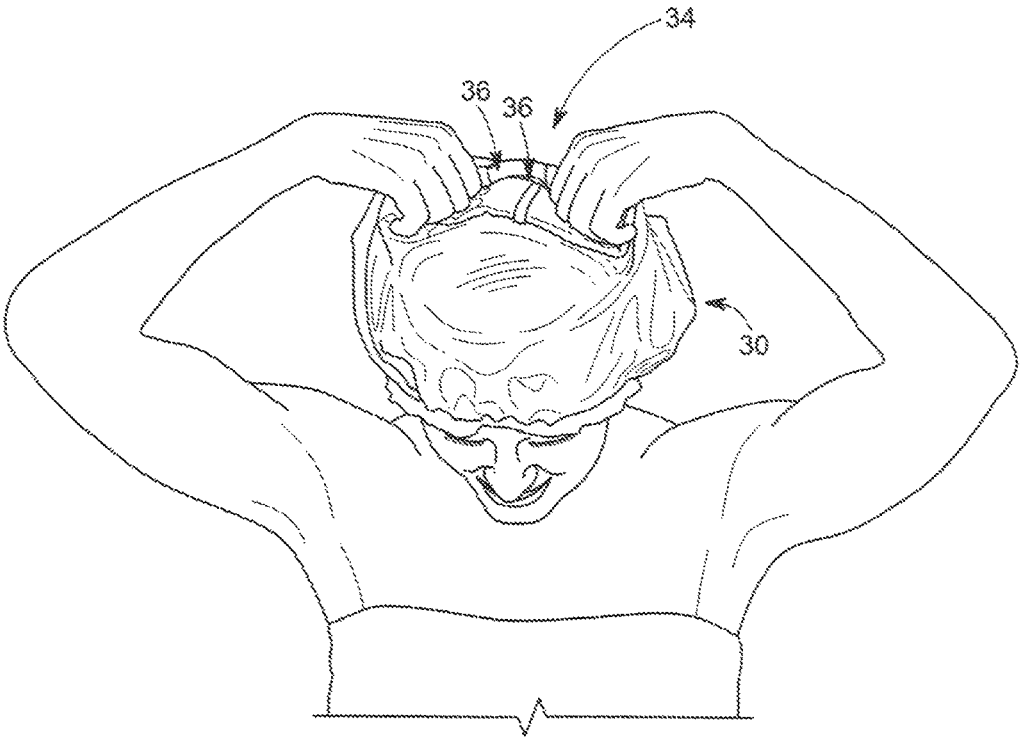

FIGS. 3A-3C show an embodiment of the shower cap 30 of the present invention on a wearer engaged in sealing the upper opening 14 using the three steps herein described. Having already placed the shower cap 30 over her head and onto her neck and then subsequently raising the cap to the position shown in FIG. 3A, the wearer has raised her hair above the hairline, and into the shower cap, where it is confined predominantly toward the top of her head. FIG. 3A shows the wearer pulling on the two strips of hook and loop fastening tape 36 outwardly at the two sides 37 of the shower cap 30 which causes the female magnetic snaps 17 and the male magnetic snaps 16 in the hem 15 to connect. Then, as is shown in FIG. 3B, the wearer creates a cuff 40 by rolling the magnetically snapped end forward toward her face. Finally, as is shown in FIG. 3C, the wearer brings the two strips of hook and loop fastening tape 36 toward the back of her head and presses them together, thereby completing the sealing process using the "snap, cuff, and fasten" system 34.

Figure 4:
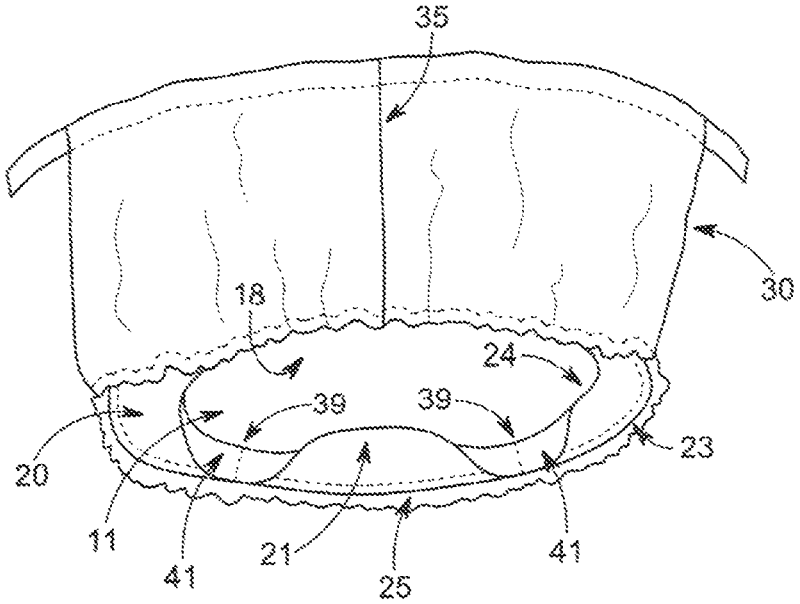
FIG. 4 shows the lower opening of an embodiment of the shower cap of the present invention comprising a wide band and waterproof ruffle.

FIG. 4 shows a preferred embodiment of the lower opening 18 of the shower cap 30 of the present invention comprising a wide stretch band 20, measuring 2.5 inches wide when laid flat 21 against the non-waterproof side 11 of the waterproof material by approximately 17 inches in circumference, said band 20 having a bottom fold 23, that is attached to the waterproof material, and a top fold 24, that is not attached to the waterproof material and a waterproof ruffle 25 at the finished edge measuring 0.5-0.6 inches. The band 20 is permanently tacked 39, in two locations, those locations being determined by establishing a center front, based on the location of the established center back 35, and then measuring, with finished lower opening 18 outstretched to its maximum, approximately 3.5 inches from the center front and on each side of the center front, and by subsequently folding the band 20 onto itself and in half, by bringing the top fold 24 toward the center of the cap and then further downward toward the lower opening 18, to meet and line up with the bottom fold 23, then by tack stitching the folded band 41 to the non-waterproof side 11 of the waterproof material, across the 1.25-inch width of the folded band 41.

Figure 5:
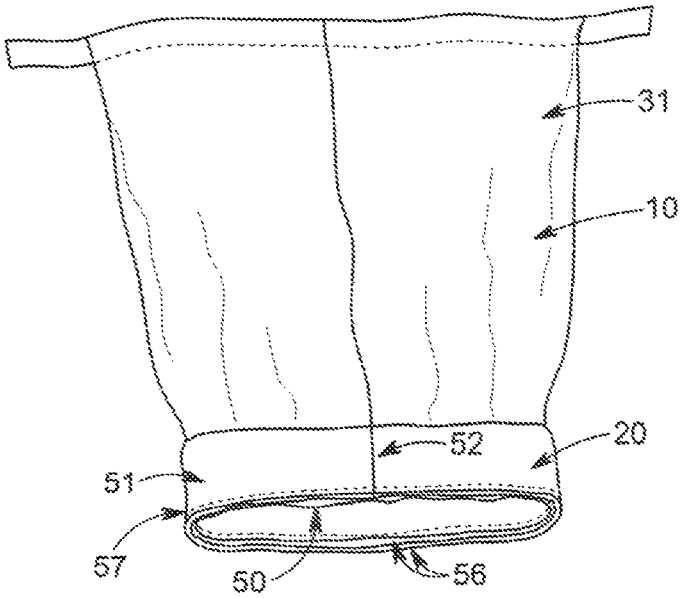
FIG. 5 shows a preferred method for attaching a wide stretch band to the lower opening of the shower cap of the present invention.
Figure 5A:
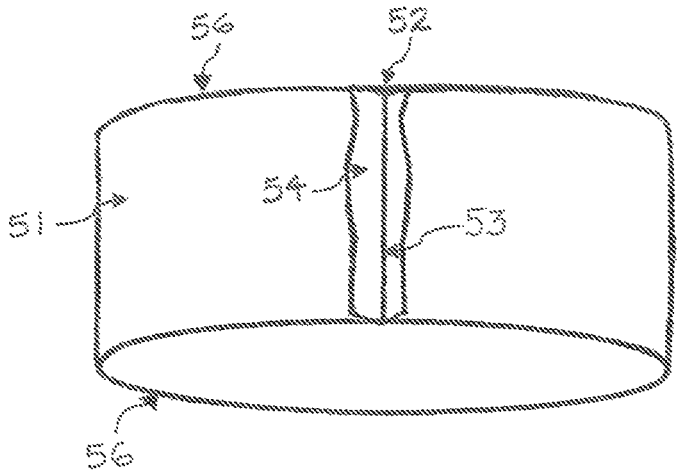
FIGS. 5A-5B show a preferred process for creating a wide stretch band which is subsequently attached to the lower opening of the shower cap of the present invention.
Figure 5B:
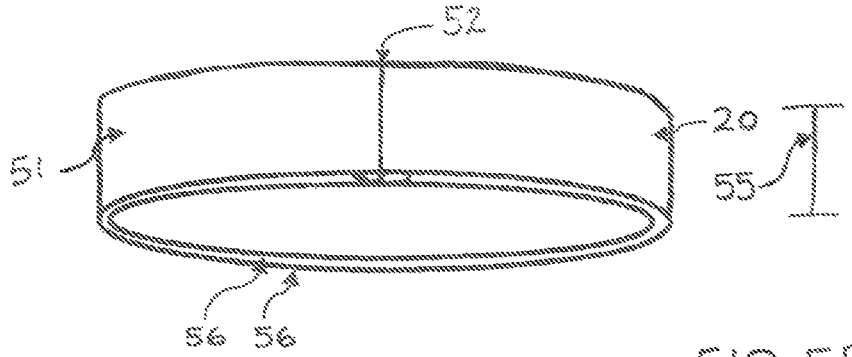
Figure 6A:
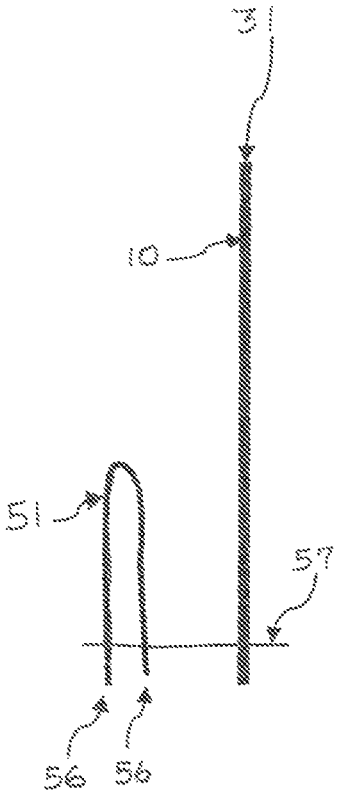
FIG. 6A is a schematic cross-section showing the preferred method for attaching the wide stretch band to the waterproof material at the lower opening of the shower cap of the present invention.

FIG. 6 shows a preferred method for attaching the wide stretch band 20 to the unfinished lower opening 50 of the waterproof material 31 of the shower cap of the present invention. Beginning with the creation of the wide stretch band, as shown in FIG. 5A, wherein a 5.5-inch, preferably with 40% percentage stretch, by 18-inch, preferably with 70% percentage stretch, section of stretch material 51, preferably stretch polyester eyelet mesh, is sewn, short sides together to be annularly shaped and possessing a center back 52 at the joining seam 53, the annularly shaped stretch material is subsequently folded, as is shown in FIG. 5B, with the seam allowance 64 hidden. The folded stretch material 51 comprising the wide stretch band 20 measures 2.75 inches in height 55 and approximately 17 inches in circumference, and possesses two remaining raw edges 56. As shown in FIG. 5, the two raw edges 56 are lined up with the unfinished lower opening 60 of the waterproof material 31 and then attached by a seam 57 to the waterproof side 10 of the waterproof material 31. This attachment is represented by the schematic cross-section shown in FIG. 6A.

FIG. 6A shows the two raw edges 56 of the stretch material 51, being attached, by sewing, and a resulting seam 57, to one layer of waterproof material 31 and on the waterproof side 10 of the waterproof material 31.

Figure 6B:
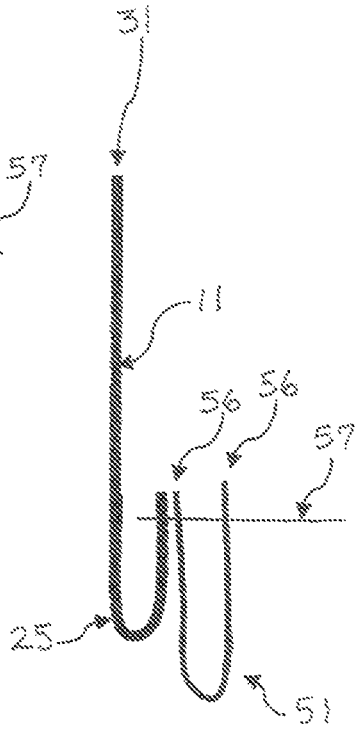
FIG. 6B-6C are schematic cross-sections of a preferred process for creating a waterproof ruffle comprising the lower opening of an embodiment of the shower cap of the present invention wherein the waterproof material is folded to create the waterproof ruffle (6B) and then stitched, to the non-waterproof side of the waterproof material, subsequent to folding over and laying flat against the non-waterproof side of the waterproof material, the wide stretch band, through which said seam is also made (6C).
Figure 6C:
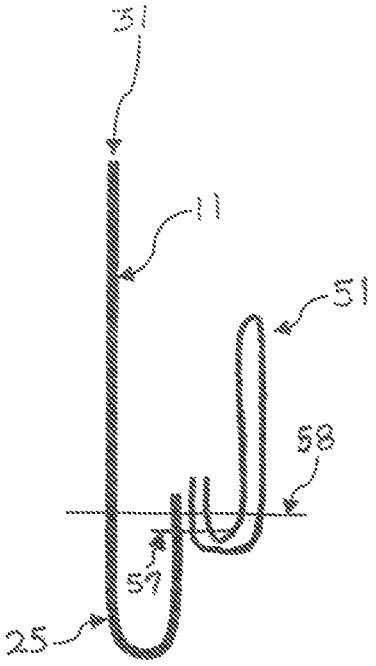

FIGS. 6B and 6C show, also in schematic cross-sections, a preferred process for subsequently creating the waterproof ruffle 25 at the lower opening of a preferred embodiment of the shower cap of the present invention. FIG. 6B shows the configuration of the seam 57, waterproof material 31, and stretch material 51, after the waterproof material 31 is folded toward the non-waterproof side 11 of the waterproof material as it would be prepared before the operation shown in FIG. 6C, wherein the stretch material 51 is folded up over the first seam 57 and further laid flat against the non-waterproof side 11 of the waterproof material 31 before stitching, the resulting seam 58 having penetrated all layers. FIGS. 6A-6C are not drawn to scale and are not intended to illustrate sizes of the involved components, neither individually nor relative to one another.

CITATION UST

Patent Literature

U.S. Pat. No. 5,920,909 July 1999 Ellsworth et al.

Non Patent Literature

U.S. patent application Ser. No. 14/756,154
U.S. patent application Ser. No. 15/222,401

I claim:

1. A shower cap/bathing cap, comprising:

a section of material, that is joined along at least one connecting seam to be uniformly column-shaped, a. an upper portion defining an upper opening, the upper portion comprising:

i. a hem, containing magnetic snaps that selectively close the upper opening, without adjusting the size of the opening, wherein, with the upper opening closed, the hem is configured to be rolled to form a cuff, ii. a pair of inwardly facing darts disposed at diametrically-opposed positions about the uniformly column-shaped section of material, and iii. a fastener engaged within each of the darts and extending outwardly therefrom, wherein pulling the fasteners outwardly in opposite directions urges the magnetic snaps into engagement with one another to close the upper opening, and wherein the fasteners are configured to engage one another with the upper portion closed and rolled, thereby maintaining the cuff;

b. a lower portion defining a lower opening, the lower portion comprising a stretch band of material that is folded and sewed to the section of material such that a ruffle is created.

2. The shower cap/bathing cap of claim 1, wherein the section of material is laminated cotton.

3. The shower cap/bathing cap of claim 1, wherein the section of material is waterproof on at least one side.

4. The shower cap/bathing cap of claim 1, wherein the section of material is laminated polyester.

5. The shower cap/bathing cap of claim 1, wherein the section of material is a woven or non-woven material.

6. The shower cap/bathing cap of claim 1, wherein the magnetic snaps are not encased within the hem.

7. The shower cap/bathing cap of claim 1, wherein the uniformly column-shaped section of material defines dimensions measuring 28.5-29 inches in circumference by 13 inches in height.

8. The shower cap/bathing cap of claim 1, wherein the stretch band defines a width measuring 2.5 inches and is folded to define a folded width of 1.25 inches.

9. The shower cap/bathing cap of claim 1, wherein the stretch band of material is comprised of a woven or non-woven stretch material.

10. The shower cap/bathing cap of claim 1, wherein the number of magnetic snaps used is more than one and less than fifteen.

11. The shower cap/bathing cap of claim 1, wherein the section of material is joined along the at least one connecting seam by sewing.

12. The shower cap/bathing cap of claim 1, wherein the fasteners are strips of hook and loop fastener tape.

13. The shower cap/bathing cap of claim 1, wherein the fasteners are tin ties threaded through the hem and protruding therefrom.

14. A method of sealing an upper opening of a shower/bathing cap, comprising:

obtaining a shower/bathing cap, including:

a section of material that defines a uniform column-shape, an upper portion defining an upper opening and including a hem containing magnetic snaps, a pair of inwardly facing darts disposed at diametrically-opposed positions about the uniform column-shape of the section of material, and a fastener engaged within each of the darts, and a lower portion defining a lower opening and including a stretch band of material that is folded and sewed to the section of material such that a ruffle is created;

engaging the magnetic snaps by pulling outwardly on, in opposite directions, each of the fasteners to thereby close the upper portion;

creating a cuff by rolling, at least once, the closed upper portion; and bringing the fasteners into engagement with one another to maintain the cuff.

15. The method of claim 14, wherein creating the cuff by rolling includes rolling the closed upper portion forwardly or rearwardly.

16. The shower cap/bathing cap of claim 1, wherein the stretch band of material is permanently tacked at more than one location.

17. The shower cap/bathing cap of claim 1, wherein the stretch band is non-continuous.

18. The shower cap/bathing cap of claim 1, wherein the fasteners are straps attached to parachute clips or tie-able strips of waterproof material.

19. The shower cap/bathing cap of claim 1, wherein the ruffle measures 0.13 inches-1.5 inches.

* * * * *